US005330174A

United States Patent [19]

Ricciardi

[11] Patent Number: 5,330,174

[45] Date of Patent: Jul. 19, 1994

[54] AUTOMATIC ARTICLE DISCHARGE INTO MAIL CONTAINER

[75] Inventor: Mario Ricciardi, Glenview, Ill.

[73] Assignee: Bell & Howell Phillipsburg Company, Allentown, Pa.

[21] Appl. No.: 2,392

[22] Filed: Jan. 12, 1993

[51] Int. Cl.[5] ..... B65H 39/10

[52] U.S. Cl. ..... 271/297; 271/185; 271/198; 271/207

[58] Field of Search ..... 198/412; 271/2, 69, 271/184, 185, 198, 202, 207, 225, 270, 275, 280, 297, 300, 305, 220

[56] References Cited

U.S. PATENT DOCUMENTS

| | | | |
|---|---|---|---|
| 2,819,079 | 1/1958 | Beaulieu | 271/202 |
| 3,095,192 | 6/1963 | Simjian | 271/220 |
| 4,047,712 | 9/1977 | Burkhardt et al. | 271/185 |
| 4,273,325 | 6/1981 | Rodewald | 271/220 |
| 4,705,157 | 11/1987 | Bowles | 271/2 |
| 5,109,987 | 5/1992 | Daboub et al. | 271/225 |

OTHER PUBLICATIONS

IBM Technical Disclosure Bulletin, Karanza, Document Twisting Transport, vol. 22, No. 10, Mar. 1980, 4619–4620.

*Primary Examiner*—H. Grant Skaggs
*Attorney, Agent, or Firm*—Millen, White, Zelano, & Branigan

[57] ABSTRACT

A device for the delivery of documents conveyed in a vertical orientation along a document path to a receptacle in a substantially horizontal orientation includes a diverter for diverting individual vertically disposed documents away from the document path in a direction toward the receptacle, a document receiving and transporting system disposed adjacent the diverter to receive the documents and progressively advancing and changing the orientation of the documents from vertical to horizontal, whereby the documents are each delivered into the receptacle in a substantially horizontal orientation.

4 Claims, 4 Drawing Sheets

AUTOMATIC ARTICLE DISCHARGE INTO MAIL CONTAINER

BACKGROUND OF THE INVENTION

The present invention relates to mass document and mail sorting equipment, and more particularly to a device for rotating envelopes transported along a mass mail sorter from a vertical position to a flat horizontal exit position and discharging the envelopes in a horizontal orientation directly into a receptacle such as a mail container.

In the use of mail sorting equipment, large numbers of envelopes are normally transported at high speeds in a vertical position or orientation along a sorting path. Apparatus within the sorting equipment automatically reads the zip code or address indicia on the envelopes, and sorts the envelopes into uniform zip code groupings to allow the user to take advantage of lower postal rates. Envelopes of similar zip code are deviated from the sorting path at predetermined locations.

In existing equipment, upon being sorted into separate bins which collect envelopes in groups bearing a uniform zip code, the envelope groups are stacked vertically in the bins. When a bin is observed by an operator to be full, or nearly full, the stack of envelopes is manually lifted and deposited into standard mail receiving receptacles or containers. In the case of larger or "flat" mail, such as catalogs, pamphlets, large envelopes of unfolded mail and the like, such grouping of material may be too heavy to be readily lifted from a bin and placed in a receiving container. Additionally, this process requires the exertion of physical labor that is avoided using the apparatus of the present invention.

A primary object of the present invention is to receive documents conveyed along a primary conveying path and diverted into a secondary document engaging and transporting path in a substantially vertical orientation, rotate the documents into a substantially horizontal direction while the documents are being conveyed in the secondary path, and delivering the documents sequentially in a substantially horizontal orientation from the secondary path into a receiving container.

Another object of the present invention is to provide a document re-orientation conveying and delivery system for a sorting apparatus which automatically adjusts to securely grip and convey documents such as mail of different thicknesses.

A further object of the present invention is to provide a document conveying and re-orientation system for a document sorting apparatus which ejects documents from a document engaging and transporting path in a horizontal orientation and in a downwardly angled trajectory to facilitate the delivery of the documents directly into a receptacle located at the end of and slightly below the end of the document engaging and transporting path.

Yet another object of the present invention is to provide a document engaging and transporting path for a sorting apparatus which engaging and transporting path extends between adjacent runs of two flexible belt systems extending between respective pairs of rollers, one roller of each pair being vertically disposed and the other roller of each pair being horizontally disposed such that as they are advanced, the documents change from a vertical to a horizontal orientation and are delivered horizontally into a receiving receptacle or container.

A further object of the present invention is to provide a document engaging and transporting path formed by a plurality of adjacent moving belts providing an entrance nip between the portions of the belts forming the nip, whereby the nip is partially defined by an idler roller which is movable to vary the position of the nip in the document engaging and transporting path.

SUMMARY OF THE INVENTION

These and other objects are provided in a document sorting apparatus for delivering documents conveyed in a substantially vertical orientation along a document path to a receptacle disposed adjacent the document path, the documents being delivered to the receptacle in a substantially horizontal orientation. The apparatus comprises a document diverter disposed along the document path for selectively diverting individual vertically disposed documents away from the document path and in a direction toward the receptacle, document receiving and transporting elements located adjacent the diverter for successively receiving each document and progressively advancing and changing the orientation of each document from substantially vertical to substantially horizontal, the document receiving and transporting elements including elements to deliver each of the documents directly into the receptacle in a substantially horizontal orientation.

BRIEF DESCRIPTION OF THE DRAWINGS

The foregoing and other objects, features and advantages of the invention will be apparent from the following more specific description of the preferred embodiment as illustrated in the accompanying drawings.

DESCRIPTION OF THE PREFERRED EMBODIMENT

Figure 1:
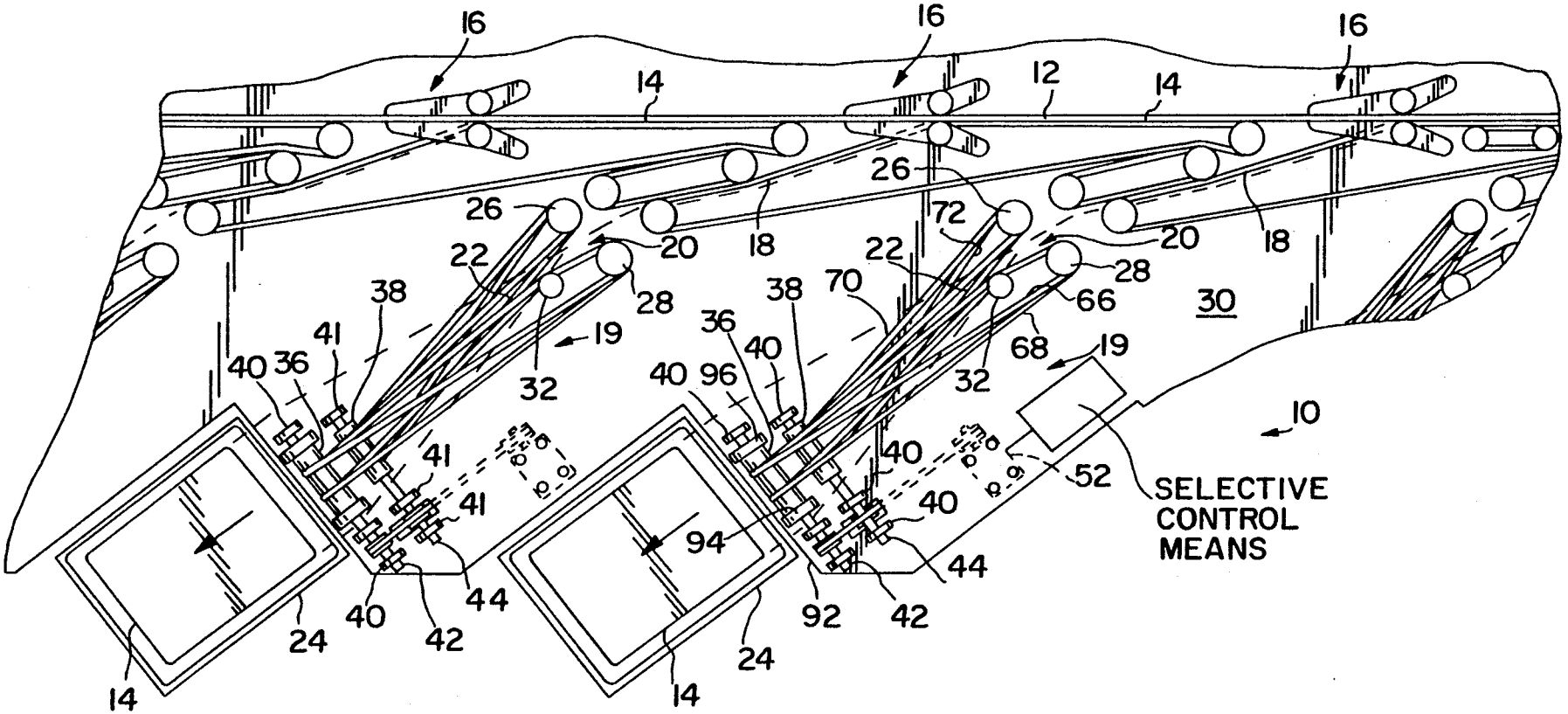
FIG. 1 is a generally schematic plan view of the conveying paths in a document sorter, showing the primary document path, several diverter mechanisms for directing documents away from the primary document path, the document re-orienting engaging and transporting path of the present invention which receives the diverted documents and rotates them ninety degrees, and the postal container or receptacle into which the documents are delivered.

FIG. 1 illustrates a document sorting apparatus generally designated by the numeral 10, which defines a primary document conveying path 12. Documents 14 traveling along path 12 are selectively diverted by means of one of a plurality of diverter mechanisms 16 out of the primary conveying path 12 and along a secondary document conveying path generally designated 18. An example of the structure of the diverter mechanism 16 is shown in applicant's commonly assigned U.S. Pat. No. 5,150,894, issued Sep. 29, 1992, entitled "Diverter Mechanism For Flat Document Conveyor System".

Documents 14 are delivered from the diverter mechanism 16 in a substantially vertical upstanding orientation into an entrance nip 20 of a document receiving and transport belt system 22 which forms the document reorienting path 19. As will be described, each belt system 22 is constructed to rotate the document 14 ninety degrees to a substantially horizontal position as the document exits the belt system 22 and is deposited horizontally directly into postal container or container 24.

The document re-orientating path 19 and belt system 22 comprise entrance idler rollers 26 and 28 which are vertically and rotatably mounted on shafts 29 (FIG. 2) extending through and upward from support surface 30 of document sorting apparatus 10. An additional idler roller 32 is located downstream from each entrance nip 20, and is rotatably mounted on platform 30 by means of shaft 33. The position of shaft 33 can be laterally adjusted, thereby increasing or decreasing the width of document path 19. Each idler roller 26, 28 and 32 includes spaced apart circumferential grooves 34, and seen in FIG. 2.

Figure 5:
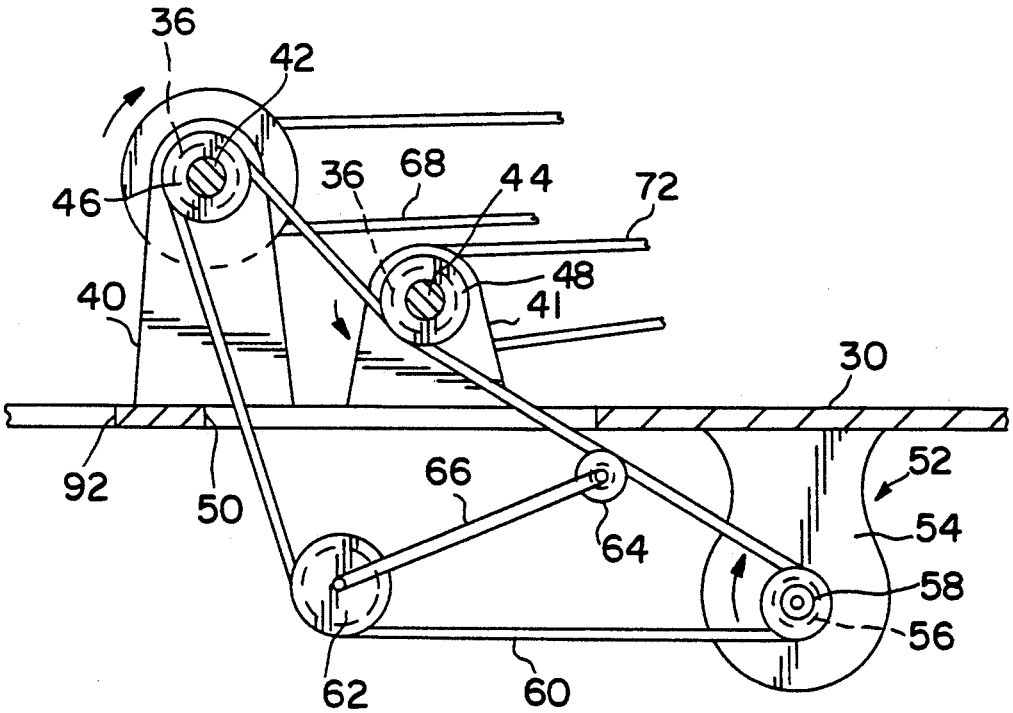
FIG. 5 is a partial sectional view of the drive elements connected to the document re-orienting apparatus taken on lines 5—5 of FIG. 2.

Each belt system 22 also comprises exit drive rollers 36, 38 horizontally mounted on platform 30 by means of a plurality of mounting brackets 40. Shafts 42, 44 are connected to drive rollers 36, 38, respectively, and are rotatably mounted in brackets 40, 41 through suitable bearing assemblies, not shown. A drive pulley 46, 48 is attached to each of shafts 42, 44 and is disposed above an aperture 50 in platform 30, as best seen in FIG. 5.

Referring again to FIG. 5, a motor assembly 52 is mounted by a bracket 54 to the underside of platform 30, and includes a drive pulley 56 attached to a motor shaft 58 driven by a suitable motor (not shown) forming part of assembly 52. A drive belt 60, preferably a timing belt, extends between drive pulleys 56, 46 and 48 to provide rotative motion to shafts 42 and 44 and drive rollers 36 and 38, respectively. As seen in FIG. 5, drive belt 60 rotates exit drive roller 36 in a clockwise direction, and simultaneously drives exit roller 38 in a counter-clockwise direction as motor 52 operates in the direction indicated by the arrow A. In the preferred embodiment of the invention, drive pulleys 46 and 48 are of equal diameter, and in similar fashion exit rollers 36 and 38 are of equal diameter. Therefore, all belts comprising belt system 22 travel at the same velocity. Timing belt 60 also extends around idler roller 62, which is connected to tensioning roller 64 by means of rod 66 for the purpose of taking up slack and maintaining the proper tension in belt 60.

Figure 2:
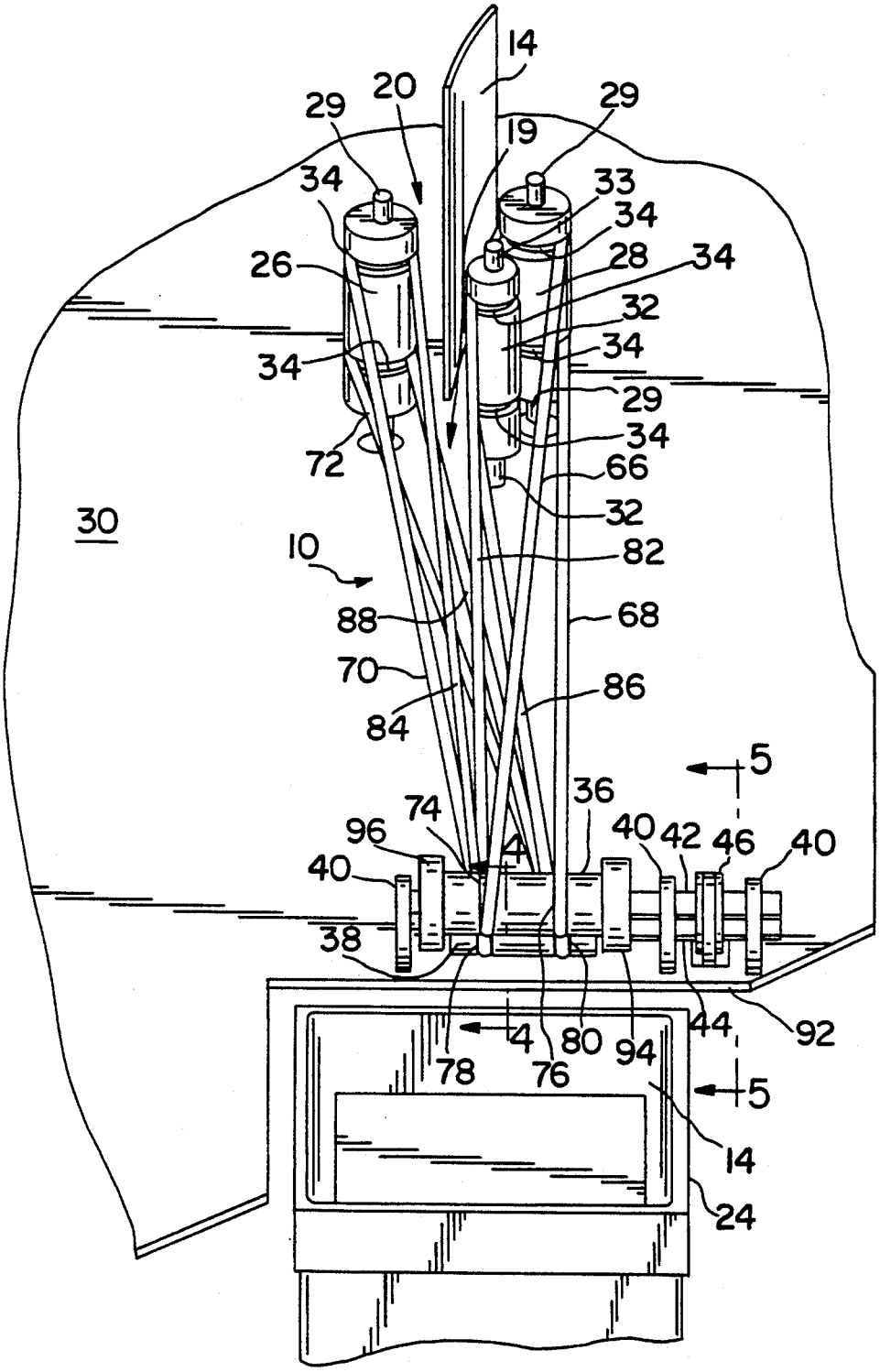
FIG. 2 is a perspective view of the document engaging and transporting path of the present invention, shown from the exit end of the document re-orienting apparatus.

Referring to FIGS. 1 and 2, each belt system 22 comprises four belts 66, 68, 70 and 72. Belt 66 extends around upper groove 34 of entrance idler roller 28, across upper groove 34 in idler roller 32, and around leftmost groove 74 in drive roller 36 from the underside of roller 36. Belt 66 continues from roller 36 and extends back to idler roller 28 to complete a loop.

Belt 68 extends around lower groove 34 in idler roller 28, across lower groove 34 in idler roller 32, and around right-hand groove 76 in drive roller 36 from the underside of roller 36. Belt 68 continues from roller 36 and extends back to idler roller 28 to complete a loop. In the preferred embodiment, the distance between upper and lower groove 34 in the idler rollers 28 and 32, and the distance between grooves 74 and 76 in drive roller 36 are all equal, such that the belts 66 and 68 are driven at the same peripheral speed.

Belt 70 of system 22 extends around upper groove 34 of entrance idler roller 26 and across support surface 30 where belt 70 extends around leftmost groove 78 circumscribing exit drive roller 38 from the underside of roller 38. Belt 70 continues around and extends from the upper side of roller 38 back across support surface 30 to idler roller 26 to complete a loop.

Belt 72 extends around lower groove 34 in idler roller 26 and across support surface 30 where belt 70 extends around rightmost groove 80 in drive roller 38 from the underside of roller 38. Belt 72 continues around and extends from the upper side of roller 38 back across support surface 30 to idler roller 26 to complete a loop.

The belt system 22 is constructed as described above to provide a document path for supporting documents 14 as they are advanced and re-oriented by the belt system, as will be explained in more detail. To this end, face 82 of belt 66 and face 84 of belt 70 extend somewhat adjacent each other, being further apart closer to entrance nip 20, and extending closer together as faces 82 and 84 approach drive rollers 36 and 38, respectively. Likewise, face 86 of belt 68 and face 88 of belt 72 extend somewhat adjacent each other, being further apart closer to entrance nip 20, and extending closer together as faces 86 and 88 approach drive rollers 36 and 38, respectively. Therefore, document engaging and transporting path 19 (FIG. 2) is formed comprising adjacent belt faces 82 and 84, and adjacent belt faces 86 and 88. Since idler rollers 26 and 28, as well as idler roller 32, are vertically oriented, and exit drive rollers 36 and 38 are horizontally oriented, document engaging and transporting path 19 twists ninety degrees from entrance nip 20 to the end of the path 19 at exit drive rollers 36 and 38. The belt faces 82, 84, 86 and 88 are adapted to engage a document 14 advanced from diverter mechanism 16 toward entrance nip 20, and to transport the document 14 toward container 24 while simultaneously rotating the document ninety degrees as the document reaches a point adjacent exit drive rollers 36, 38. The belt systems 22 are flexible enough to prevent bending or damaging documents 14 as they are re-oriented, and can accommodate documents of varying thicknesses.

Figure 3:
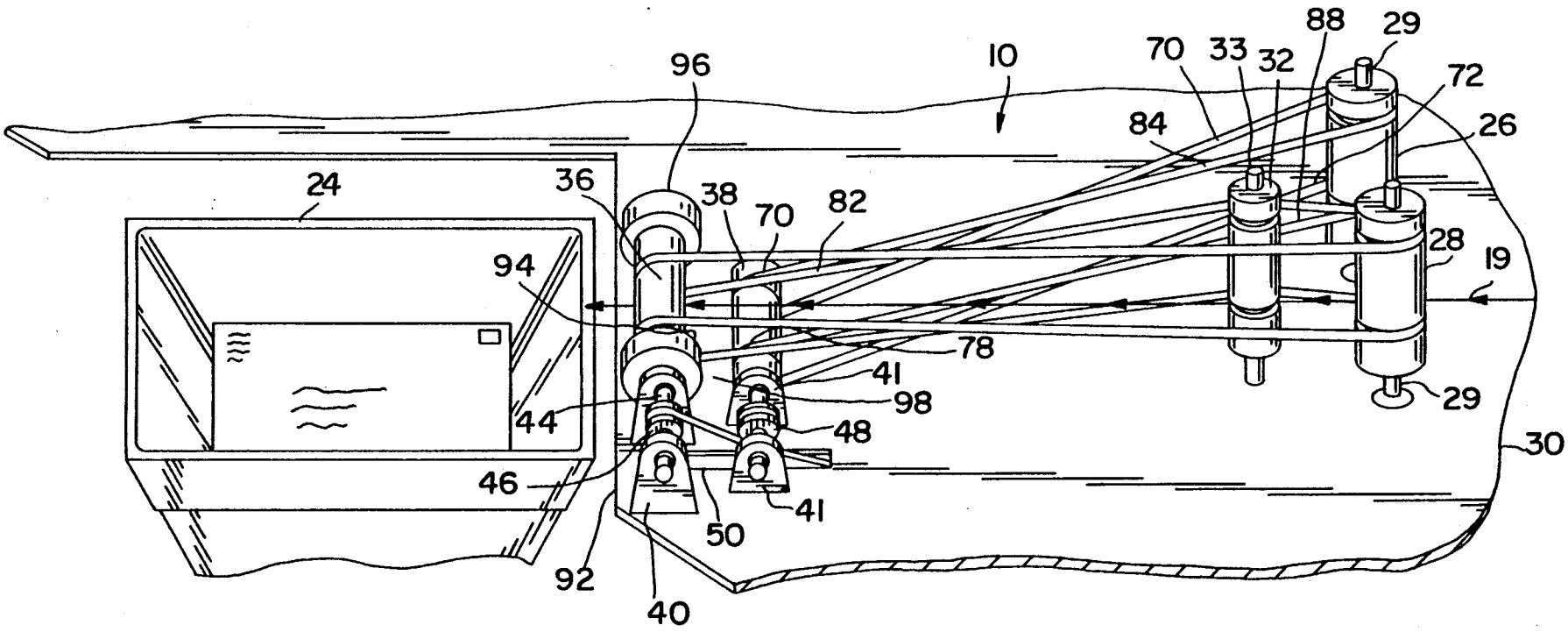
FIG. 3 is a perspective view of the document engaging and transporting path of FIG. 2 viewed from a location transverse to the direction of transport of the documents with the documents being transported from right to left.
Figure 4:
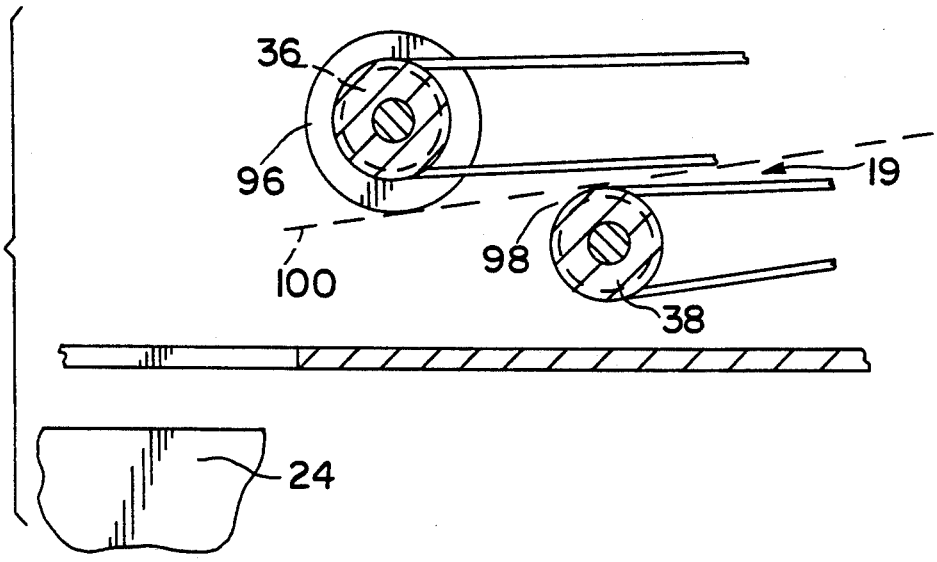
FIG. 4 is a partial sectional view of the exit rollers taken on lines 4—4 of FIG. 2.

As seen in FIG. 3, exit drive roller 36 is mounted on brackets 40 close to an edge 92 of support surface 30. Exit roller 38 is similarly mounted by brackets 41 to support surface 30, only exit roller 38 is located upstream of exit roller 36 in relation to path 19. Additionally, as best seen in FIGS. 3 and 4, exit roller 36 includes two deflecting rollers 94, 96 extending circumferentially substantially adjacent either end of roller 36. Rollers 94, 96 are made of urethane, or any other suitable material. The outer diameter of rollers 94, 96 is such that the lower circumferential extent of rollers 94, 96 is disposed beneath the horizontal plane formed tangentially with the upper surface of exit roller 38 just ahead of exit nip 98 of path 19. The actual line of tangency between the lower extent of deflecting rollers 94, 96 and the upper circumferential surface of exit roller 38 is shown as line of tangency 100 in FIG. 4. The purpose of the relationship between the circumference of deflecting rollers 94, 96 and the upper surface of roller 38 is to provide a downward directing force on the document 14 as it passes through exit nip 98 of path 19.

In operation, referring first to FIG. 1, an envelope 14 is diverted from primary document conveying path 12 by a diverter mechanism 16 with sufficient force to propel the document along secondary document conveying path 18 and into entrance nip 20 of a document engaging and belt system 22. At this juncture, the document 14 is in a vertical orientation, and the leading edge of the document comes into contact with face 84 of belt 70 and face 88 of belt 72, which faces are moving in a direction from idler roller 26 towards drive roller 38. Idler roller 32 has been previously adjusted to provide a space between faces 84, 88 of belts 70, 72 and faces 82, 86 of belts 66, 68, respectively, which space is slightly less than the thickness of document 14, whereby the document 14 is urged forward and into contact with belt faces 82 and 86. Thus, vertically oriented document 14 is now engaged between belt faces 84 and 88 on one side, and by belt faces 82 and 86 on the other side just downstream of entrance nip 20. As the belt faces advance, document 14 is transported along path 19 toward exit nip 98.

Motor assembly 52 (FIGS. 1 and 5) drives belts 66, 68, 70 and 72 at substantially equal velocity due to the construction of the power drive train operating entrance idler rollers 26, 28 and exit drive rollers 36, 38, and due to the substantially equal diameter dimensions of each of rollers 26, 28, 36 and 38. As a result of the substantially equal velocity of each of the belts in system 22, the envelope 14 is firmly retained between adjacent and contiguous inner upper belt faces 82 and 84, and inner lower belt faces 86 and 88 as the document is transported from entrance nip 20 to exit nip 98 along path 19. Since the belts 66, 68, 70 and 72 are each twisted ninety degrees from entrance rollers 26, 28 to exit rollers 36, 38, the envelope 14 is rotated from a vertical orientation to an ultimate horizontal orientation at the end of path 19.

Referring to FIG. 4, as document 14 approaches exit nip 98, the upper side of horizontally disposed document 14 contacts the lower circumferential surface of deflecting rollers 94, 96, which apply a downward force to the leading edge of the advancing document. This downward force directs the leading edge and the remainder of document 14 along line of tangency 100. Document 14 thus leaves exit nip 98 having a trajectory substantially equivalent to line of tangency 100 and downwardly angled with respect to path 90 and directly toward the interior of container 24. Following this trajectory, the leading edge of document 14 impacts the far end of container 24 below the upper lip of the container. At the same time, the trailing edge of document 14 leaves exit nip 98 and clears edge 92, the document drops down into container 24, and resides horizontally in container 24. This process is repeated until container 24 is full, at which time the container is removed and replaced with an empty container.

The above-described arrangement of belts and rollers allows the present invention to transport sorted documents 14 of various dimensions without the need for adjustment of the belt system 22. The document 14 is engaged by two sets of upper and lower belt runs 82, 84 and 86, 88 as the document passes slightly ahead of entrance nip 20. Should the document 14 be thicker than the width of path 19 at idler roller 32, the left side of the document will force belt rims 84 and 88 laterally outward. Although the resiliency of belts 70 and 72 applies a lateral force to the left side of the document, the force is insufficient to damage the contents of the document, where the document is an envelope containing an article.

Also, upon entering nip 20, belts 70 and 72 engage the left side of the envelope at two vertically spaced locations, and belts 66 and 68 grip the right side of the envelope at two vertically spaced, but contiguous, locations. By grasping the document 14 at these four locations, the orientation of the document, irrespective of the document's height, as it is rotated between entrance rollers 26, 28 and exit rollers 36, 38, closely corresponds to the orientation of path 19.

The present invention contemplates that motor assembly 52 includes suitable controls to vary the speed of motor shaft 58, and consequently, vary the speed of movement of belt system 22. This allows the belt system to be slowed to a speed of linear travel in path 19 which is less than the speed of documents 14 arriving at entrance nip 20 from diverter 16. This will form the documents 14 in path 19 in a shingled array or stack. The shingled stack will then be rotated ninety degrees as described previously, and the documents 14 will be progressively deposited in container 24 as the documents reach and pass through exit nip 98.

A specific embodiment of the present invention has been described for the purposes of illustrating the manner in which the invention may be made and used. It should be understood that implementation of other variations and modifications of the invention in its various aspects will be apparent to those skilled in the art and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A device for the delivery of documents conveyed in a substantially vertical orientation along a document path to a receptacle disposed adjacent said document path, said documents being delivered to said receptacle in a substantially horizontal orientation, comprising:

diverting means disposed along said document path for selectively diverting individual substantially vertically disposed documents away from said document path in a direction toward said receptacle;

document receiving and transporting means disposed adjacent said diverting means successively receiving each document and progressively advancing and changing the orientation of said documents directed from said document path from said substantially vertical orientation to said substantially horizontal orientation;

said document receiving and transporting means including means for delivering each of said documents directly into said receptacle in a substantially horizontal orientation;

said document receiving and transporting means comprising:

first belt means extending between first substantially vertical roller means and first substantially horizontal roller means;

second belt means extending between second substantially vertical roller means and second substantially horizontal roller means;

drive means to move said first and second belt means around said respective roller means;

one face of said first belt means and one face of said second belt means being driven by said drive means in the same direction and adjacent one another to form a document engaging and transporting path between said belt means;

said document engaging path being disposed in a substantially vertical orientation adjacent said first substantially vertical roller means, said path rotating sustantially ninety degrees along the length of said path to said substantially horizontal roller means, said path being disposed substantially horizontal adjacent said second substantially horizontal roller means;

said document engaging path including a document exit nip between said first substantially horizontal roller means and said second substantially horizontal roller means;

said exit nip being substantially horizontally disposed and adapted to transport each successive document from said document engaging path directly into said receptacle;

said first substantially horizontal roller means rotating about a first axis, and said second substantially horizontal roller means rotating about a second axis; and, said first axis disposed at a distance downstream from said second axis relative to said document engaging path.

2. The document delivery device of claim 1 wherein:

said first substantially horizontal roller means includes a first circumferential surface about which said first belt means extends, and said second substantially horizontal roller means includes a second circumferential surface about which said second belt means extends;

the lower extent of said first circumferential surface extending in a vertical diameter below the upper extent of said second circumferential surface, wherein said document are deflected downward by the lower extent of said first circumferential surface as said documents are conveyed through said exit nip.

3. The document delivery device of claim 1 including:

additional roller means extending circumferentially around said first substantially horizontal roller means;

said additional roller means having a diameter greater than the diameter of said first substantially horizontal roller means;

said additional roller means engaging each document passing through said exit nip and urging each said document in a downward direction into said receptacle.

4. The document delivery device of claim 3 wherein said additional roller means comprises a resilient material.

* * * * *